United States Patent [19]

Kitner et al.

[11] Patent Number: 4,756,455

[45] Date of Patent: Jul. 12, 1988

[54] UTILITY SADDLEBAG FOR WATERCRAFT

[76] Inventors: William Kitner, 4425 Palos Verdes Dr., North Rolling Hills Estates, Calif. 90274; Thomas J. Calamia, 4507 Whitney, El Monte, Calif. 91731

[21] Appl. No.: 22,066

[22] Filed: Mar. 5, 1987

[51] Int. Cl.[4] ..... B60R 9/00

[52] U.S. Cl. ..... 224/42.11; 114/364; 224/273; 224/275

[58] Field of Search ..... D12/307, 155, 156; D3/40; 224/273, 42.42, 275, 42.01, 42.11; 114/343, 364, 346; 383/4

[56] References Cited

U.S. PATENT DOCUMENTS

| | | | |
|---|---|---|---|
| 1,839,862 | 1/1932 | Bartlett | 224/42.11 X |
| 2,813,602 | 11/1957 | MacArthur, Jr. | 224/42.11 X |
| 3,876,126 | 4/1975 | Kearney | 224/273 X |
| 3,958,289 | 5/1976 | Carlson | 114/364 |
| 3,986,574 | 10/1976 | Irvine | 224/42.42 X |
| 4,569,301 | 2/1986 | Pyburn | 114/364 X |

*Primary Examiner*—Henry J. Recla
*Assistant Examiner*—Robert Petrik
*Attorney, Agent, or Firm*—Albert O. Cota

[57] ABSTRACT

A utility saddlebag which has a top (20), sides (26), and ends (30) and (32), of woven fabric attached together by seams of thread configured to cover the engine compartment enclosure of a jet-propelled watercraft. The saddlebag is held in place by the use of an elastic member (36) sewn into a bead on the skirt or periphery of the device allowing it to be stretched over and held in place by tucking the ends under the edges of the housing. A number of pockets (28) on the sides and on the rear (34) provide storage compartments, and a strap (40) assures closure on the sides. The invention provides storage for a watercraft, without any modification or alteration heretofore unavailable.

7 Claims, 1 Drawing Sheet

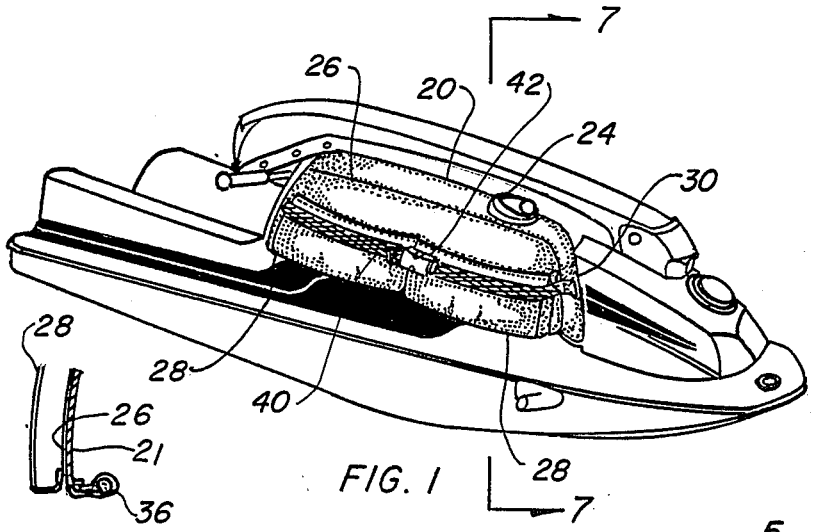
FIG. 1
FIG. 7
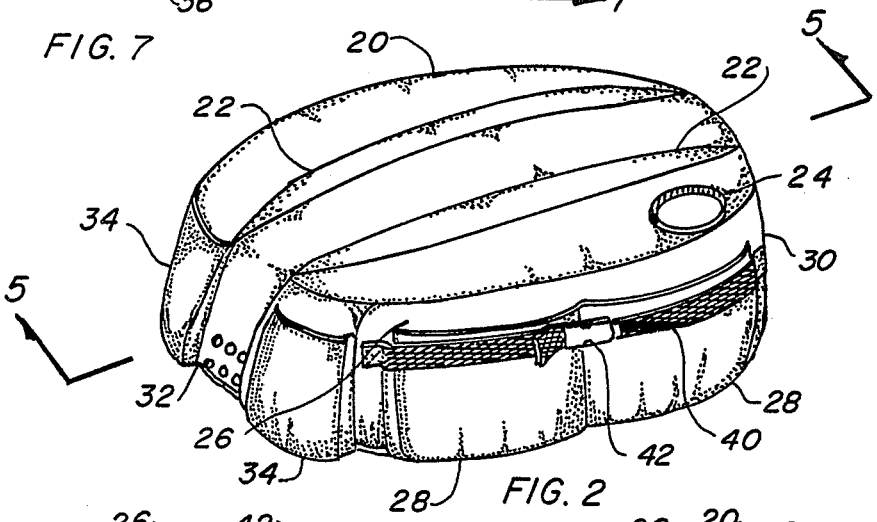
FIG. 2
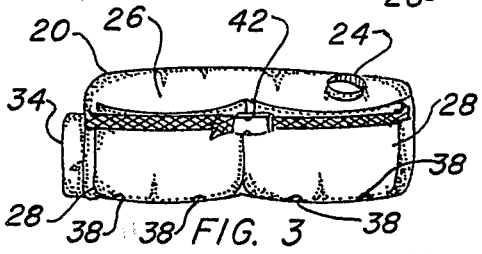
FIG. 3
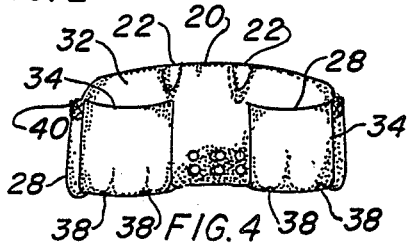
FIG. 4
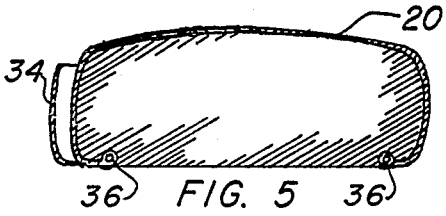
FIG. 5
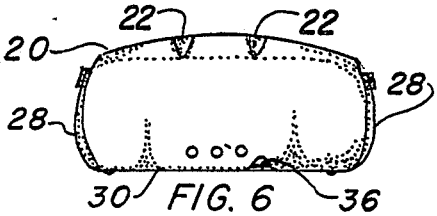
FIG. 6

UTILITY SADDLEBAG FOR WATERCRAFT

TECHNICAL FIELD

The present invention relates to vehicle storage containers in general, and more specifically to a pocket containing cover for a jet-propelled watercraft.

BACKGROUND ART

Previously, many types of bags have been used in endeavoring to provide an effective means of storage of goods on various vehicles. Examples of this prior art include pannier bags for bicycles, motorcycles, and pack animals. In most cases, these have been limited to a type of saddlebag that balances the weight on each side of a structure or body. This art is also replete with external pockets for storing goods therein.

A search of the prior art did not disclose any patents that read directly on the claims of the instant invention, however, the following U.S. patents were considered related:

| Patent No. | Inventor | Issue Date |
|---|---|---|
| 4,580,706 | Jackson et al | Apr. 8, 1986 |
| 4,491,258 | Jones | Jan. 1, 1985 |
| 4,442,960 | Vetter | Apr. 17, 1984 |
| 4,402,439 | Brown | Sep. 6, 1983 |
| 4,345,703 | Allen | Aug. 24, 1982 |
| 4,258,869 | Hilgendorff | Mar. 31, 1981 |

Jackson et al teach a saddlebag arrangement for cycles that includes a cut-away in the forward lower corner portion for heel clearance. A U-shaped bar is also employed as part of an internal frame. Straps secure the bag in place with a rigid strap mounted to a fixed part of the cycle.

Vetter discloses a pair of saddlebags for a motorcycle that join together with flexible straps which straddle the vehicle. Compartments are formed with a protective cover within, having buckles adjustably securing the ends of the straps. A pair of handles are included with each housing through which each housing may be carried individually or in combination.

Brown utilizes a frame for his bicycle pannier bag that is streamlined in the direction of travel. A flexible cover is used to enclose the frame and maintain the shape. A zipper provides entrance into the bag and a strip of reflective fabric is used on the outer surface cover to increase visibility during periods of darkness.

Hilgendorff teaches a saddlebag primarily for pack animals, but adaptable to humans and other means of transportation, such as snowmobiles and motorcycles. A curvilinear cut-out is included that is specifically configured to conform to the cantle base of a saddle. Each side of the housing include an open top compartment with a flexible cover and a separate overflap. The cover providing a shelf for a subcompartment formed on top of the compartment between the cover and the overflap. The side housings contain zippered end compartments. The web includes at least one pouch formed therein.

For background purposes and as indicative of the art to which the invention relates, reference may be made to the remaining cited patents.

It is clearly evident that prior art utilizes saddlebags, for carrying objects, that are specifically designed for a particular animal, or vehicle, and, in most cases, these are quite distinct, even if adaptable within the same gender. As an example, a bicycle is general in nature and specifically configured, allowing one basic embodiment to fit almost all styles. This is evident in motor driven cycles, however, since the advent and popularity of jet-propelled watercraft, the need has been apparent for a bag that would provide storage, however, any prior art available has severly lacked in adaptability to be used with a highly specialized apparatus, such as this waterborne vehicle. The specific shape of the watercraft does not allow the use of just any bag and as the craft is oftimes overturned provisions must be made to endure this circumstance. Further, the specific shape is unique to this type of vehicle and its attachment must not interfere with its basic operation.

With this in mind, it is a primary object of the invention to provide a storage saddlebag allowing articles to be stowed and easily reached on a specific jet-propelled watercraft having no inherent means for attachment. This watercraft is characterized by the so-called JET SKI manufactured by Kawasaki Motors Corp.

Another object of the invention is the location of the saddlebag over the top of the engine compartment enclosure providing an accessible and convenient position placing pockets on each of the sides and on the end nearest the operator of the craft. This allows access to the pockets when the operator is kneeling in a driving position.

Another object of the invention allows installation to be accomplished without any modification to the watercraft itself. This is accomplished using elastic tape on the periphery of the saddlebag and tucking the end under the lower edge of the engine compartment enclosure securely positioning the device in a self-centering and contoured manner.

Still another object of the invention provides a secure compartment or pocket in the sides by the use of a single strap that is easily attached or removed. This is particularly important allowing the objects to be held in place if the craft overturns, but accessible without cumbersome zippers, buttons, or snaps, that are hard to operate when wet or from outside of the craft if the operator is in the water.

A final object of the invention provides drain ports in the bottom of the pockets allowing the water to be dispelled when the craft overturns, or fills with water, due to the wake of other boats or the inherent operating environment of the craft itself.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 1 is a partial isometric view of the preferred embodiment installed on a watercraft.

FIG. 2 is an isometric view of the preferred embodiment.

FIG. 3 is a side elevational view of the preferred embodiment.

FIG. 4 is a rear elevational view of the preferred embodiment.

FIG. 5 is a cross-sectional view taken along lines 5—5 of FIG. 2.

FIG. 6 is a front elevational view of the preferred embodiment.

FIG. 7 is a partial cross-sectional view taken along line 7—7 of FIG. 1.

BEST MODE FOR CARRYING OUT THE INVENTION

The best mode for carrying out the invention is presented in terms of a preferred embodiment. The preferred embodiment, as shown in FIGS. 1 through 6 is comprised of a top 20 shaped to follow the domed contour with flat sides of the engine compartment enclosure 21 of a jet-propelled watercraft. The top 20 of the invention, in order to achieve this shape, utilizes a pair of elongated sections 22 tapered to a point on each end and positioned in parallel relationship to a longitudinal section located therebetween. This configuration allows the top 20 to match identically to the domed contour of the craft preventing wrinkles, or bulges, from occurring when justapositioned with the compartment enclosure.

The invention is directed to all jet-propelled watercraft in general, but more specifically to a JET SKI manufactured by Kawasaki Motors Corp. This particular apparatus includes an engine air intake port, or combustion air intake manifold scoop, on the top of the engine compartment housing, therefore, a seamed round opening 24 in the invention encloses this port uniformly, so as to allow air to enter unrestricted.

Attached to the top 20 are sides 26 on each opposed vertical plane. These sides 26 are also formed in the same shape as the engine compartment enclosure 21, just as the top is, and they further contain a number of storage pockets 28 on the outside near the bottom edge. The pockets 28 are attached on three sides with the top open providing easy access to the interior. The pockets may be flat or formed in such a manner as to extend beyond the surface for greater capacity, in either event they provide ample and convenient means to store articles inside.

Attached similarly to the above elements are a front end 30 and a rear end 32, also contoured in the same manner. The assembly now forming a complete wrapper capable of covering the entire engine compartment enclosure. The rear end 32 also utilizes a series of storage pockets, not unlike those described above. These pockets 34 are directly accessible to the driver of the watercraft, as they are below the steering arm and while in a kneeling position, may be easily reached.

The saddlebag is held in place on the watercraft by securing means that allow the sides and ends to be tucked beneath the lower edge of the engine compartment enclosure 21. These securing means are in the form of an elastic member 36, such as synthetic rubber strands woven into a cloth material, a plurality of stretchable bands encompassed by a woven fabric commonly known as a bungee cord, or any other stretchable substance embedded into the periphery of the saddlebag. The elastic material, in its relaxed state, is smaller than the periphery of the saddlebag causing the form to be pulled inward at the bottom. When the saddlebag is stretched over the engine compartment, the elastic member 36 urges the top 20, sides 26, and ends 30 and 32, into conformance while tucking under the edge securely holds the device in place. This method of attachment allows a stable, yet removable mode of connection without any modification to the watercraft structure.

The construction materials of the above elements may be of any woven fabric having sufficient integrity to retain objects within the pockets when subject to the environment of a watercraft. This includes synthetic fabrics, such as nylon, dacron, polyester, and the like, or even natural woven fibers, such as cotton, as all of the preferred material of construction consist basically of a woven fabric stretching the components together, preferably accomplished by sewing with thread. This sewing method includes attachment of the top 20 to the sides 26 and ends 30 and 32, as well as the pockets 28 and 34. This type of construction allows the exact shape to be determined by each piece, assuring a tight fit all around.

As the saddlebag is subjected to occasional submersion in water, as a result of the watercraft falling on its side, each pocket 28 or 34 contains a number of drain ports 38 in the bottom. These ports 38 may be any type of opening, however, a grommet is preferred, as it allows the water to drain freely and covers the edges of the hole preventing fraying of the edges of the hole. Occasional submerging of the watercraft on its side creates another problem with the side pockets 28 in that material stored inside may be accidently dislodged. To preclude this situation, a pair of straps 40 are attached at the outside edge of each set of pockets 28. These straps 40 utilize connecting means in the form of a quick release fastener 42, allowing each end to be joined, forcing the pockets 28 underneath in a flat position on the top creating a compressed closure. This arrangment allows easy access to the pockets when the strap is removed, even if the driver is in the water at the side or in a kneeling position in the cockpit of the watercraft. The quick release fastener 42 may be any type suitable for the purpose, with clamping action, over center lever, hooks, and the like, being entirely adequate.

In operation the utility saddlebag is stretched over the vehicle engine compartment enclosure 21 and secured beneath the lower edge of the enclosure edges with the elastic member 36 retracting, holding it securely in place. Articles are placed in the pockets and the straps 40 are connected together securing the pockets 28 and 34.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

We claim:

1. A utility saddlebag for a jet-propelled watercraft having an engine compartment enclosure in dome shape with flat sides and an open bottom comprising:

(a) a top configured in such a manner as to follow the domed contour of the engine compartment of the watercraft such that a duplication of the shape is achieved;

(b) said top having a seamed round opening to uniformly encompass the air intake port for the engine of the watercraft;

(c) longitudinal sides, each having a plurality of storage pockets attached on three sides with the top open providing a repository for articles placed therein;

(d) a front and rear end contoured to fit over the engine compartment of the watercraft with the rear having a plurality of storage pockets accessible to the driver of the watercraft; and, (e) securing means to hold the saddlebag in place with the sides and ends tucked beneath the lower edge of the engine compartment enclosure providing attachment therewith, the saddlebag allowing articles to be stowed on the outside of the watercraft and accessible to an operator.

2. The utility saddlebag as recited in claim 1 further comprising; the top, sides and ends fashioned of a woven fabric having sufficient integrity to retain objects within said pockets when subjected to the environment of a watercraft.

3. A utility saddlebag for a jet-propelled watercraft having an engine compartment enclosure in dome shape with flat sides and an open bottom comprising:

(a) a top configured in such a manner as to follow the domed contour of the engine compartment of the watercraft such that a duplication of the shape is achieved; said top having a pair of elongated sections tapered to a point on each end positioned in parallel relationship with a longitudinal portion therebetween defining a domed configuration characterizing the shape of the top of the engine compartment of said jet-propelled watercraft, (b) said top having a seamed round opening to uniformly encompass the air intake port for the engine of the watercraft;

(c) longitudinal sides, each having a plurality of storage pockets attached on three sides with the top open providing a repository for articles placed therein;

(d) a front and rear end contoured to fit over the engine compartment of the watercraft with the rear having a plurality of storage pockets accessible to the driver of the watercraft; and, (e) securing means to hold the saddlebag in place with the sides and ends tucked beneath the lower edge of the engine compartment enclosure providing attachment therewith, the saddlebag allowing articles to be stowed on the outside of the watercraft and accessible to an operator.

4. The storage pockets of the saddlebag as recited in claim 1 further comprising; attachment with seams of thread on the sides and bottom thereof.

5. The storage pockets of the saddlebag as recited in claim 3 further comprising; said pockets having a plurality of drain ports in the bottom thereof to allow water trapped inside in the event of the watercraft overturning to be drained therefrom.

6. A utility saddlebag for a jet-propelled watercraft having an engine compartment enclosure in dome shape with flat sides and an open bottom comprising:

(a) a top configured in such a manner as to follow the domed contour of the engine compartment of the watercraft such that a duplication of the shape is achieved;

(b) said top having a seamed round opening to uniformly encompass the air intake port for the engine of the watercraft;

(c) longitudinal sides, each having a plurality of storage pockets attached to three sides with the top open providing a repository for articles placed therein;

(d) a front and rear end contoured to fit over the engine compartment of the watercraft with the rear having a plurality of storage pockets accessible to the driver of the watercraft;

(e) securing means to hold the saddlebag in place with the sides and ends tucked beneath the lower edge of the engine compartment enclosure providing attachment therewith, the saddlebag allowing articles to be stowed on the outside of the watercraft and accessible to an operator; and (f) an elastic member embedded into a sewn seam on the periphery of the saddlebag urging the bag into a shape having the sides and ends resiliently seek a diameter smaller on the seam allowing the saddlebag to be stretched over the engine compartment of said watercraft with the elastic member urging conformance to the shape and tucking under the edge to securely hold the device in place under the tensioning influence of the elastic member.

7. The utility saddlebag as recited in claim 6 further comprising; a pair of straps positioned over the pockets in such a manner as to hold objects securely within said straps having connecting means on the ends to attach together and provide a quick release therefrom.

* * * * *